US011597564B2

(12) United States Patent
French

(10) Patent No.: US 11,597,564 B2
(45) Date of Patent: Mar. 7, 2023

(54) ADJUSTABLE RECORDING HERB AND SPICE SHAKER

(71) Applicant: Maria Shanee French, Detroit, MI (US)

(72) Inventor: Maria Shanee French, Detroit, MI (US)

( * ) Notice: Subject to any disclaimer, the term of this patent is extended or adjusted under 35 U.S.C. 154(b) by 0 days.

(21) Appl. No.: 17/197,247

(22) Filed: Mar. 10, 2021

(65) Prior Publication Data

US 2021/0284391 A1 Sep. 16, 2021

Related U.S. Application Data

(60) Provisional application No. 62/987,420, filed on Mar. 10, 2020.

(51) Int. Cl.

| | |
|---|---|
| ***B65D 25/56*** | (2006.01) |
| ***B65D 83/06*** | (2006.01) |
| ***A47G 19/24*** | (2006.01) |
| ***B65D 43/02*** | (2006.01) |

(52) U.S. Cl.

CPC ..... *B65D 25/56* (2013.01); *A47G 19/24* (2013.01); *B65D 43/0222* (2013.01); *B65D 83/06* (2013.01); *B65D 2203/04* (2013.01); *B65D 2203/12* (2013.01)

(58) Field of Classification Search

CPC .... B65D 25/56; B65D 43/0222; B65D 83/06; B65D 2203/04; B65D 2203/12; A47G 19/24; A47G 19/34

See application file for complete search history.

(56) References Cited

U.S. PATENT DOCUMENTS

| | | | | |
|---|---|---|---|---|
| 2,579,388 | A * | 12/1951 | Lowry | A47G 19/34 222/362 |
| 2,623,660 | A * | 12/1952 | Warren | A47G 19/24 222/565 |
| 3,446,403 | A * | 5/1969 | Serio | A47K 5/08 222/162 |
| 4,961,521 | A * | 10/1990 | Eckman | A47G 19/24 222/545 |
| 6,302,301 | B1 * | 10/2001 | Vette | B65D 47/265 220/259.5 |
| 2005/0155968 | A1 * | 7/2005 | Kosmyna | B05B 7/2478 220/23.83 |
| 2011/0155746 | A1 * | 6/2011 | Armen | B65F 1/141 29/428 |
| 2013/0248537 | A1 * | 9/2013 | Lane | B65D 25/2888 220/574.3 |
| 2015/0216361 | A1 * | 8/2015 | Tsui | A47J 43/27 366/130 |
| 2021/0284391 | A1 * | 9/2021 | French | B65D 83/06 |

* cited by examiner

*Primary Examiner* — Bob Zadeh

(74) *Attorney, Agent, or Firm* — Jacob M. Ward; Ward Law Office LLC

(57) ABSTRACT

A shaker device includes a storage body, a lid, and a measurement system. The storage body also includes an opening and a hollow area. The storage body is configured to retain and selectively dispense an amount of a material disposed in the shaker device. The opening is disposed on a terminal end of the storage body. The lid is selectively disposed over the opening. The measurement system is configured to identify an amount of the material within the shaker device.

13 Claims, 11 Drawing Sheets

ADJUSTABLE RECORDING HERB AND SPICE SHAKER

CROSS REFERENCE TO RELATED APPLICATIONS

This application claims the benefit of U.S. Provisional Application Ser. No. 62/987,420, filed on Mar. 10, 2020. The entire disclosure of the above application is incorporated herein by reference.

FIELD

The disclosure generally relates to measurement tools, and more particularly, to culinary measuring tools.

INTRODUCTION

This section provides background information related to the present disclosure which is not necessarily prior art.

There are numerous culinary tools that allow one to measure out a predetermined amount of herbs/spices. These culinary tools allow measurement of an exact amount of material as in preparation of a known recipe or creation of a new recipe. However, these culinary tools often require a user to go through additional steps to measure a particular amount and require performance of certain calculations. These additional steps may include utilizing multiple increments of measuring cups and measuring spoons, resulting in more utensils that require cleaning thereafter. These additional steps can be viewed as cumbersome for many users and serves to encourage many users to not measure when they cook. Instead, a user may resort to season their food by "eyeballing," or measuring by sight or by taste. This process of eyeballing may result in errors when following or creating a recipe. The eyeballing technique also makes it difficult for the user to achieve consistency in taste when trying to reproduce recipes.

There is a continuing need for a culinary measuring tool that may measure an amount of material a user dispenses without adding additional steps, transfers, and calculations to the culinary process. Desirably, the culinary measuring tool may enhance repeatability of recipes.

SUMMARY

In concordance with the instant disclosure, a culinary measuring tool in the form of a shaker device, which can measure an amount of material a user dispenses without adding additional steps, transfers, and calculations to the culinary process, while also enhancing the repeatability of recipes, has surprisingly been discovered.

Culinary measuring tools according to the present technology may include a shaker device. The shaker device may be configured to retain and selectively dispense a material. The shaker device may include a storage body, a lid, and a measurement system. The storage body may include an opening. In a specific example, the opening may be disposed on a terminal end of the storage body. The lid may be selectively disposed over the opening. The measurement system may be configured to identify an amount of the material within the shaker device.

Various ways of using such shaker devices are provided. These include where a shaker device is provided that includes a storage body, a lid, and a measurement system. A first measurement of an amount of a material in the shaker device can be acquired. Next, a portion of the material from the shaker device can be dispensed. A second measurement of the amount of the material in the shaker device can then be acquired, whereby a difference between the first measurement and the second measurement provides a dispensed amount of the portion of the material.

In certain embodiments, shaker devices and ways of using such can include additional aspects. The storage body may be constructed of plastic. The storage body may selectively move bidirectionally inside of an outer cover. The outer cover may also be made of plastic. The outer cover may have a content window that is configured to permit a user to visually see the amount of material within the storage body. The measurement system may be disposed on the outer cover and further disposed adjacently to the content window. The bidirectional motion of the storage body within the outer cover allows a user to move the measurement system on the outer cover in relation to the amount of material within the storage body. For instance, the measurement system may have a zero mark, which may be selectively disposed at a substantially same height as the amount of material within the storage body. It should be appreciated that the measurement system may include any desired volumetric unit and/or increment of measurement, within the scope of the present disclosure.

The lid may include a perforated lid which permits the material within the storage body to be dispensed in a controlled manner. The lid may be selectively coupled to the terminal end of the storage body. For instance, the lid and the terminal end of the storage body may include complementary threading portions. The lid may be selectively coupled to the terminal end of the storage body using the complementary threading portions. The storage body may further include a cap that may be disposed over each of the lid and the terminal end of the storage body. The cap may be configured to seal in the material within the storage body and militate against spills. The cap may be coupled to one of the storage body and the lid. The cap may be selectively coupled to one of the storage body and the lid by complementary threaded area or a friction fit design.

In certain embodiments, the shaker device includes a plunger. The plunger may fit snugly inside a hollow area of the storage body. The plunger may have slightly extended edges around a top surface of a head of the plunger. The extended edges may facilitate the material to move bi-directionally inside the storage body. As the plunger is moved bi-directionally in the hollow area of the storage body, the extended edges may be disposed along a circumference of a wall of the storage body to militate against the material from bypassing the head of the plunger.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
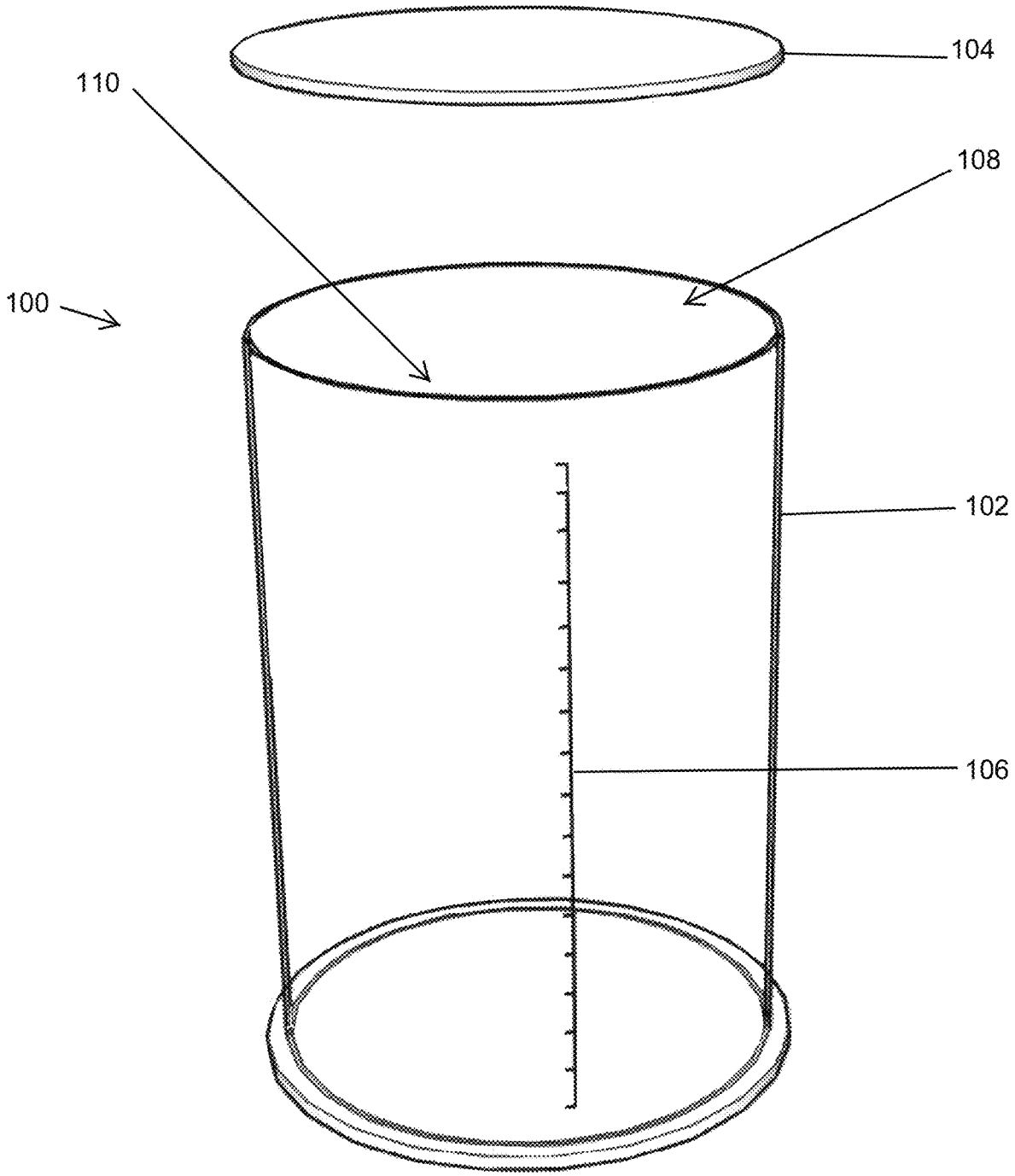
FIG. 1 is a front perspective, exploded view of a shaker device, depicting a storage body with a substantially transparent sidewall, according to one embodiment of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology relates to a shaker device for retaining and selectively dispensing a material and uses thereof. The shaker device may include a storage body, a lid, and a measurement system. The storage body may include an opening and a hollow area. In a specific example, the opening may be disposed on a terminal end of the storage body. The lid may be selectively disposed over the opening. The measurement system may be configured to identify an amount of the material within the shaker device.

In certain embodiments, the shaker device may include an outer cover configured to receive the storage body within a cavity of the outer cover. The outer cover may have a content window and the storage body made be constructed from a translucent and/or a transparent material. The measurement system may be disposed on the content window, adjacent to the content window, or on the content window and adjacent to the content window. The measurement system may include a range of units of measurement. The range of units of measurement may include an increasing scale starting from zero. Advantageously, the measurement system may be configured to measure a volume of the material within the storage body. Desirably, the measurement system may provide an expeditious way to acquiring a measurement of the amount of material within the storage body.

In certain embodiments, the outer cover may be bi-directionally slidably disposed over the storage body. The outer cover may be coupled to the storage body through a friction fit. The friction fit may include where an outer circumference of the storage body is substantially the same size as an inner circumference of the outer cover. The friction fit may also include a tab feature disposed on the inner circumference of the outer cover and a plurality of ridges along a length of the outer circumference of the storage body. Advantageously, the friction fit coupling may militate against the outer cover from unintentionally moving along the storage body. One skilled in the art may select other suitable methods of coupling the outer cover to the storage body, within the scope of the present disclosure.

In certain embodiments, a user may slide the outer cover in relation to the storage body until a desired first measurement is obtained along the range of units of measurement. For example, the first measurement may be obtained by aligning a desired unit on the range of units of measurement with an amount of material within the storage body, which may be visible through the content window. Where there is not enough material within the storage body to line up with the desired unit, the outer cover may be slid bi-directionally along the storage body until the material is in line with the desired unit on the measurement system.

In certain embodiments, the measurement system may include an indication arrow, the indication arrow may be selectively moveable along the range of units of measurement. The indication arrow may be configured to mark the first measurement based on the amount of the material within the storage body. It should be appreciated that other marking or indicative structures other than an "arrow" are included within the scope of the present disclosure.

In certain embodiments, the shaker device may include the following features. The lid of the storage body may be a perforated lid configured to control the amount of material dispensed from the shaker device. In one example, the lid may include a pouring protrusion configured to direct a flow of the material from the storage body. The shaker device may further include a selectively removable cap disposed over the perforated lid. The selectively removable cap may include a hinged door. The selectively removable cap may be coupled to the lid and/or the storage body. In a specific example, the selectively removable cap may be coupled to the lid and/or the storage body by complementary threaded portions and a friction fit.

In certain embodiments, the shaker device may include a dispensing apparatus configured to selectively release the material in a predetermined amount. In a specific example, the dispensing apparatus may include an indexing rotatable handle disposed on a terminal end of the storage body. Advantageously, the dispensing apparatus may allow a user to release a predictable and repeatable amount of material. One skilled in the art may select other ways of releasing a predictable and repeatable amount of material, within the scope of the present disclosure.

In certain embodiments, the storage body may include another opening, a content window disposed in a sidewall of the storage body, and a plunger disposed within the storage body through the another opening. The plunger may be configured to conform to an interior sidewall of the cross-sectioned storage body. The measurement system may be disposed on one of the sidewall of the storage body and the content window. The measurement system may include a range of units of measurement increasing in a scale starting from zero. The plunger may include a head configured to be disposed adjacent to the material along the measurement system. The head may further be configured to indicate a volume or a measurement of the material within the storage body along the range of units of measurement. Advantageously, the plunger may be configured to push the material within the storage. Where the material clumps up or has excessive spacing, the plunger may desirably compress the material to militate against inaccurate measurement readings. A skilled artisan may select other suitable methods of pushing the material within the storage body, within the scope of the present disclosure.

In certain embodiments, the shaker device may include a scale disposed within the storage body. The scale may be configured to measure a mass of the material within the storage body. The shaker device may further include a display configured to show the measured mass. In a specific example, the scale may be disposed on an opposite terminal end of the storage body in relation to the opening. The shaker device may further include a control panel permitting an external input to the scale. In a more specific example, the scale may be a digital scale. Advantageously, the scale may militate against inaccurate readings by clearly displaying the exact measurement reading. Desirably, the digital scale may be further configured to automatically calculate the difference between the first measurement and a second measurement after a portion of the material has been dispensed from the shaker device.

In certain embodiments, the shaker device may include a scale disposed within the storage body, a content window disposed in the sidewall of the storage body, and a range of units of measurement disposed on the sidewall of the of the storage body. Advantageously, the shaker device having the scale and the range of units of measurement disposed on the sidewall of the storage body may be configured to measure volume and/or mass. Desirably, the shaker device may be accommodating to recipes requiring increments of material in volume and mass without needing additional measurement devices. As non-limiting examples, the shaker device may be capable of measuring in volumetric units of teaspoons, tablespoons, cubic centimeters, milliliters, etc., and in gravimetric units of ounces, grams, etc. One skilled in the art may select other units of volume and/or mass, within the scope of the present disclosure.

Turning now to the accompanying figures provided herewith, particular embodiments of the present technology are shown.

With reference to FIG. 1, the shaker device 100 includes a storage body 102, a lid 104, and a measurement system 106. The storage body 102 includes an opening 108 disposed on the terminal end of the storage body 102. The storage body 102 also includes the hollow area 110. With continued reference to FIG. 1, the storage body is constructed from a substantially transparent and/or translucent material.

Figure 2:
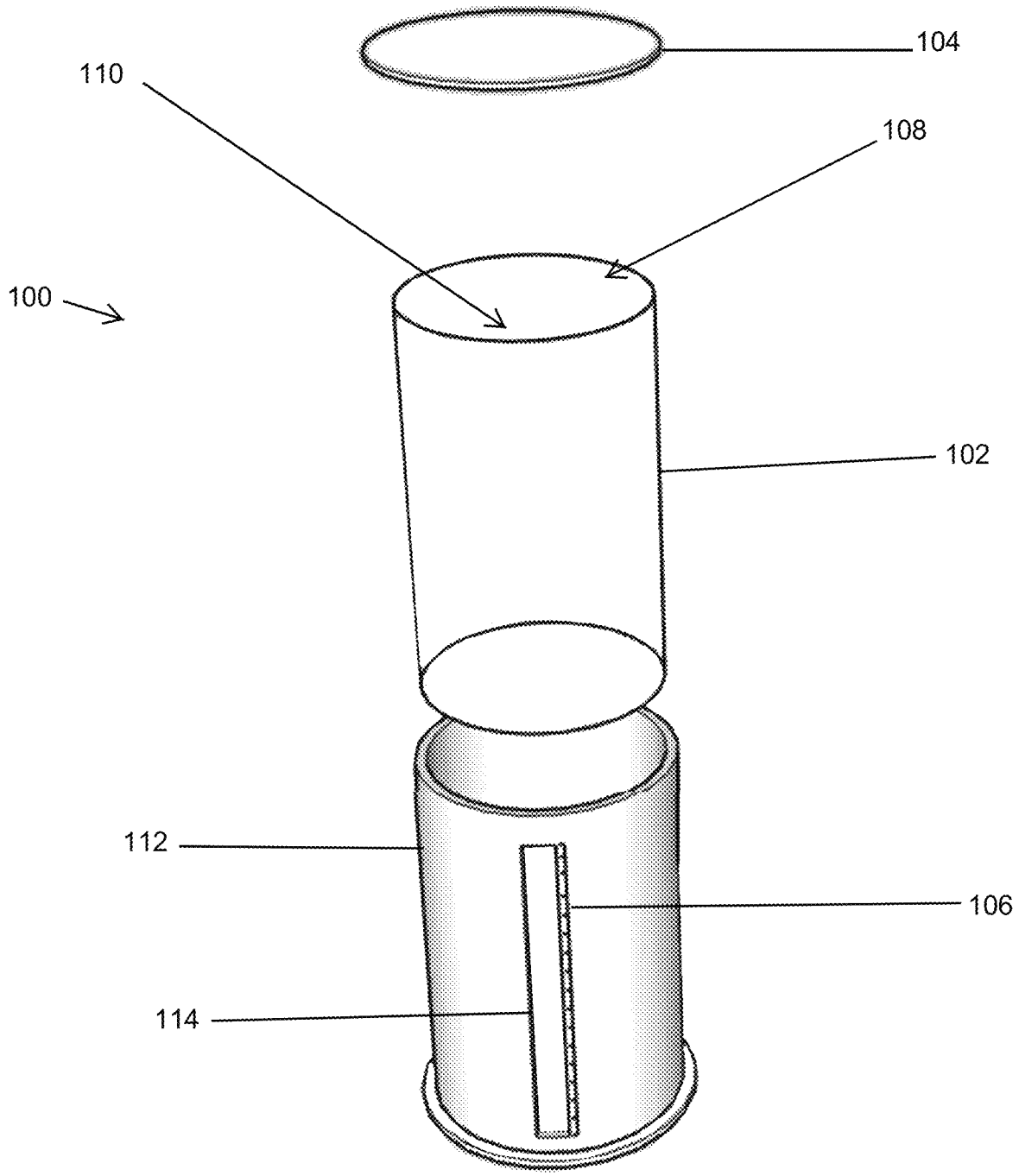
FIG. 2 is a front perspective, exploded view of the shaker device, depicted with an outer cover including a content window, according to a second embodiment of the present disclosure.
Figure 3:
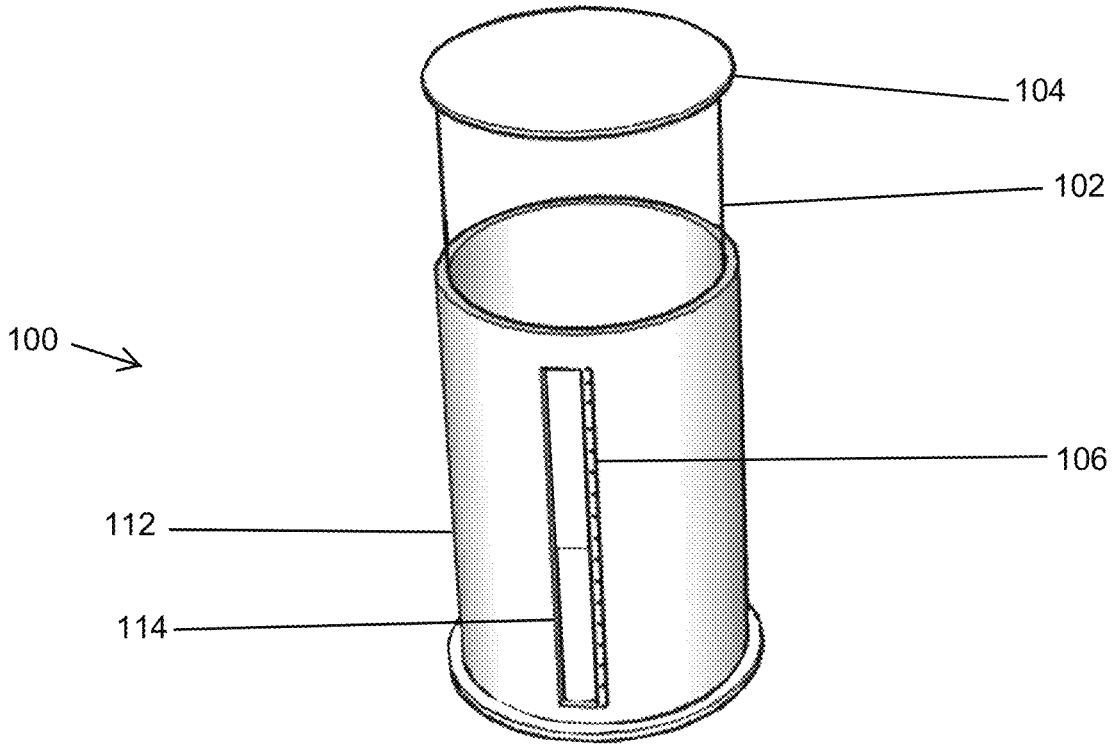
FIG. 3 is a front perspective view of the shaker device, as shown in FIG. 2, depicted with the storage body being inserted into the outer cover, according to the second embodiment of the present disclosure.

With reference to FIGS. 2-3, certain embodiments of the shaker device 100 includes an outer cover 112 configured to accept the storage body 102 therein. The outer cover 112 has a content window 114. The content window 114 is constructed from one of a translucent and a transparent material. The measurement system 106 is further disposed on the outer cover 112, adjacent to the outer cover 112, or on the outer cover 112 and adjacent to the outer cover 112.

Figure 4:
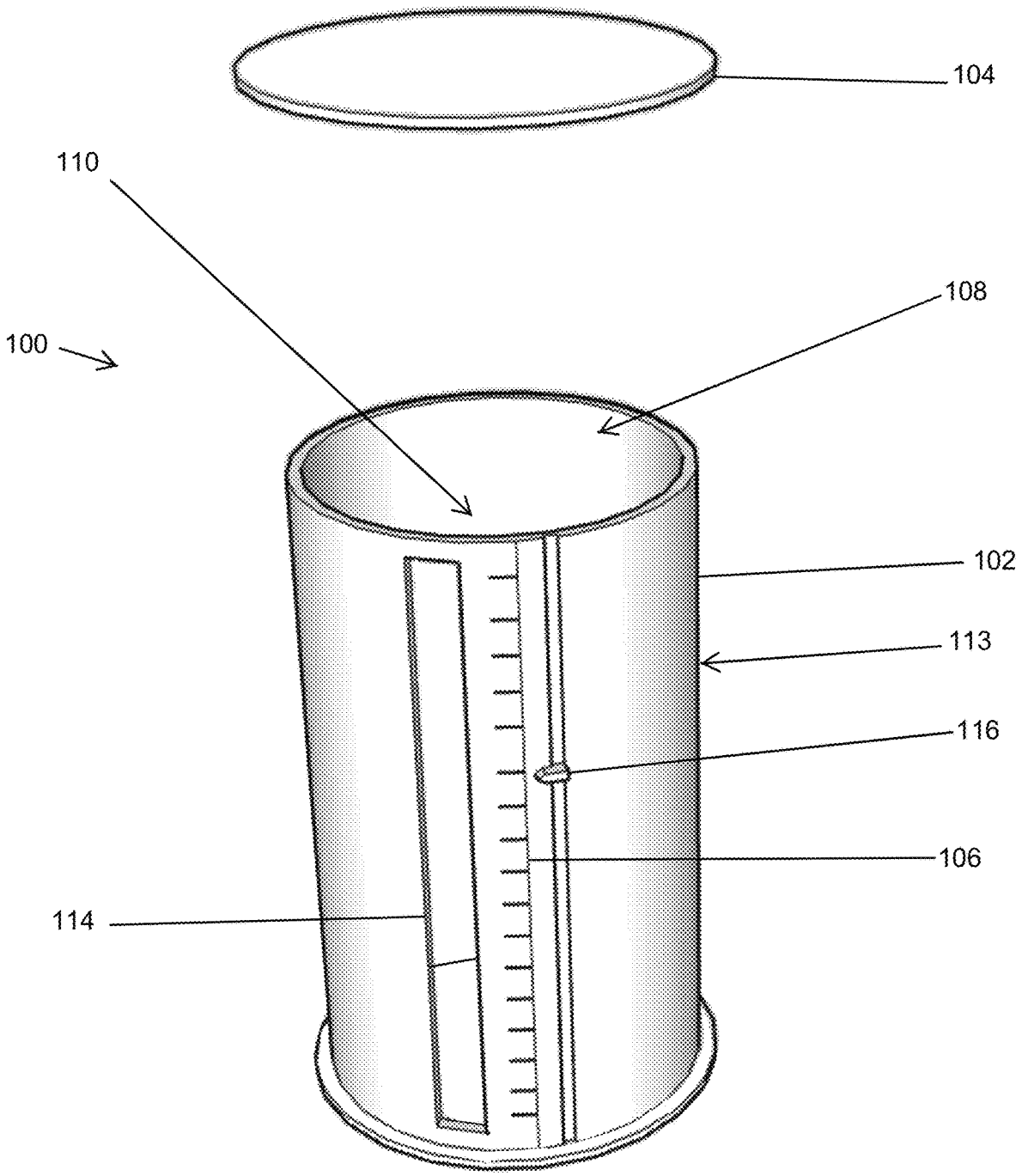
FIG. 4 is a front perspective, exploded view of the shaker device, depicted with the storage body having a substantially opaque sidewall, a content window, and an indication arrow disposed adjacent to the measurement system, according to a third embodiment of the present disclosure.

With reference to FIG. 4, certain embodiments of the shaker device 100 include the storage body 102 having a substantially opaque sidewall 113. Where the storage body 102 includes the substantially opaque sidewall, the storage body 102 also includes the substantially transparent or substantially translucent content window 114. As shown in FIG. 4, the measurement system 106 includes the indication arrow 116.

Figure 5:
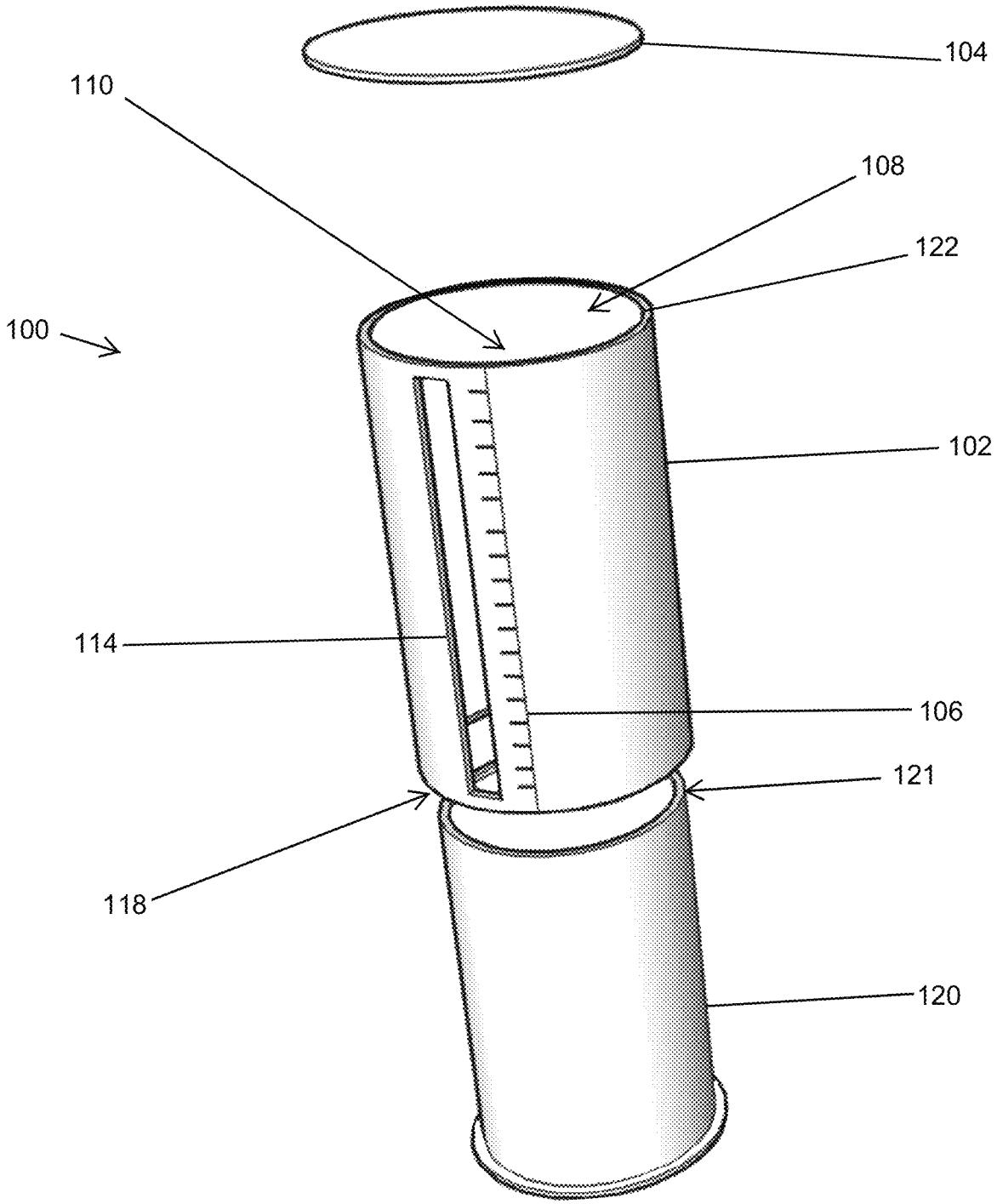
FIG. 5 is a front perspective, exploded view of the shaker device, depicted with another opening and a plunger configured to be disposed through the another opening, according to a fourth embodiment of the present disclosure.

With reference to FIG. 5, the storage body 102 includes another opening 118 disposed on an opposite terminal end of the storage body 102. The shaker device 100 further includes a plunger 120 configured to be inserted through the another opening 118 and into the hollow area 110 of the storage body 102. The plunger includes a head 121 configured to conform to an interior sidewall 122 of the storage body 102.

Figure 6:
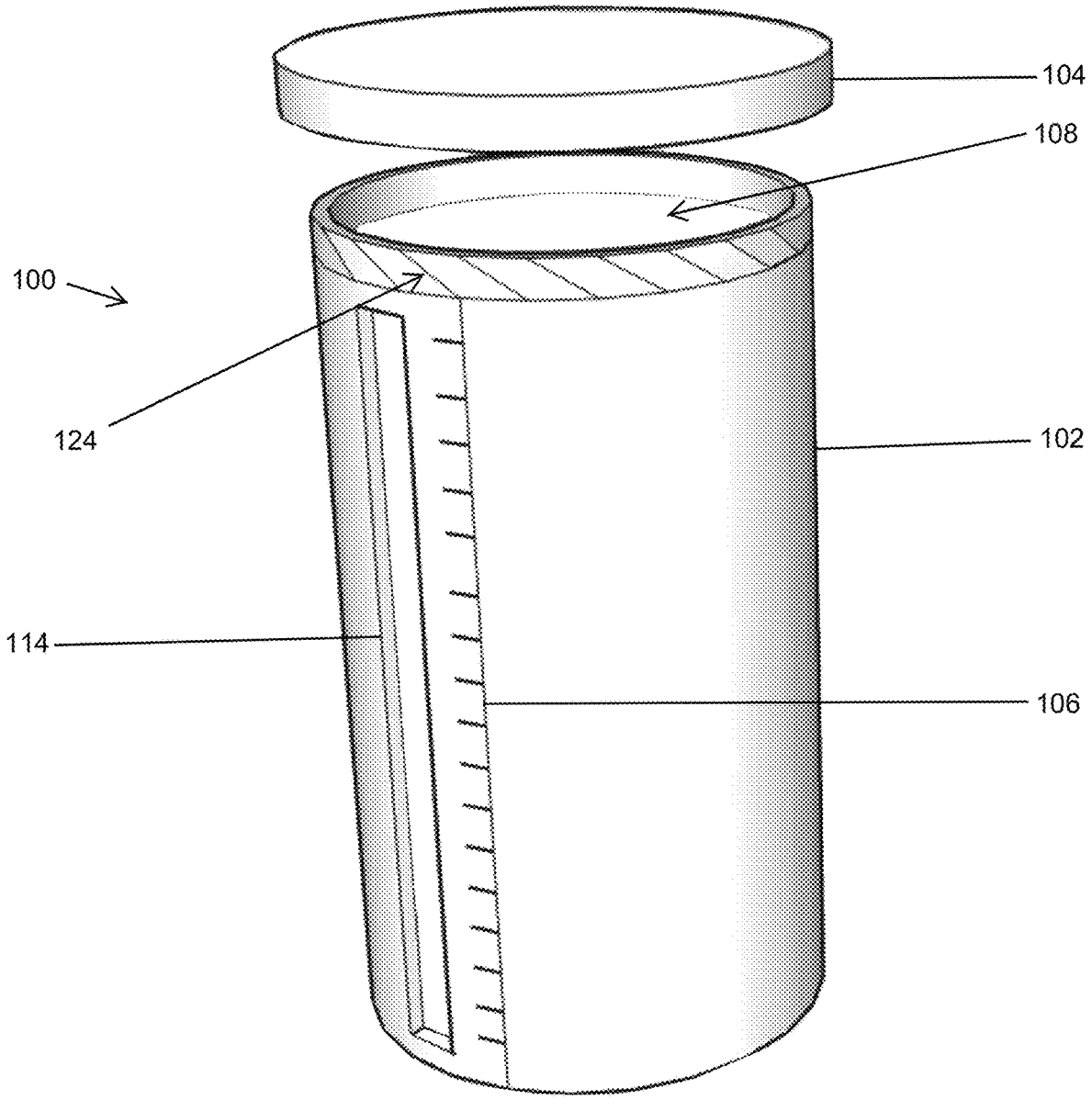
FIG. 6 is a front perspective, exploded view of the shaker device, depicted with a threaded portion configured to selectively couple the lid to the storage body, according to a fifth embodiment of the present disclosure.

With reference to FIG. 6, the storage body 102 and the lid 104 have complementary threaded portions 124. The complementary threaded portions 124 are configured to selectively couple the lid 104 to the storage body 102.

Figure 7:
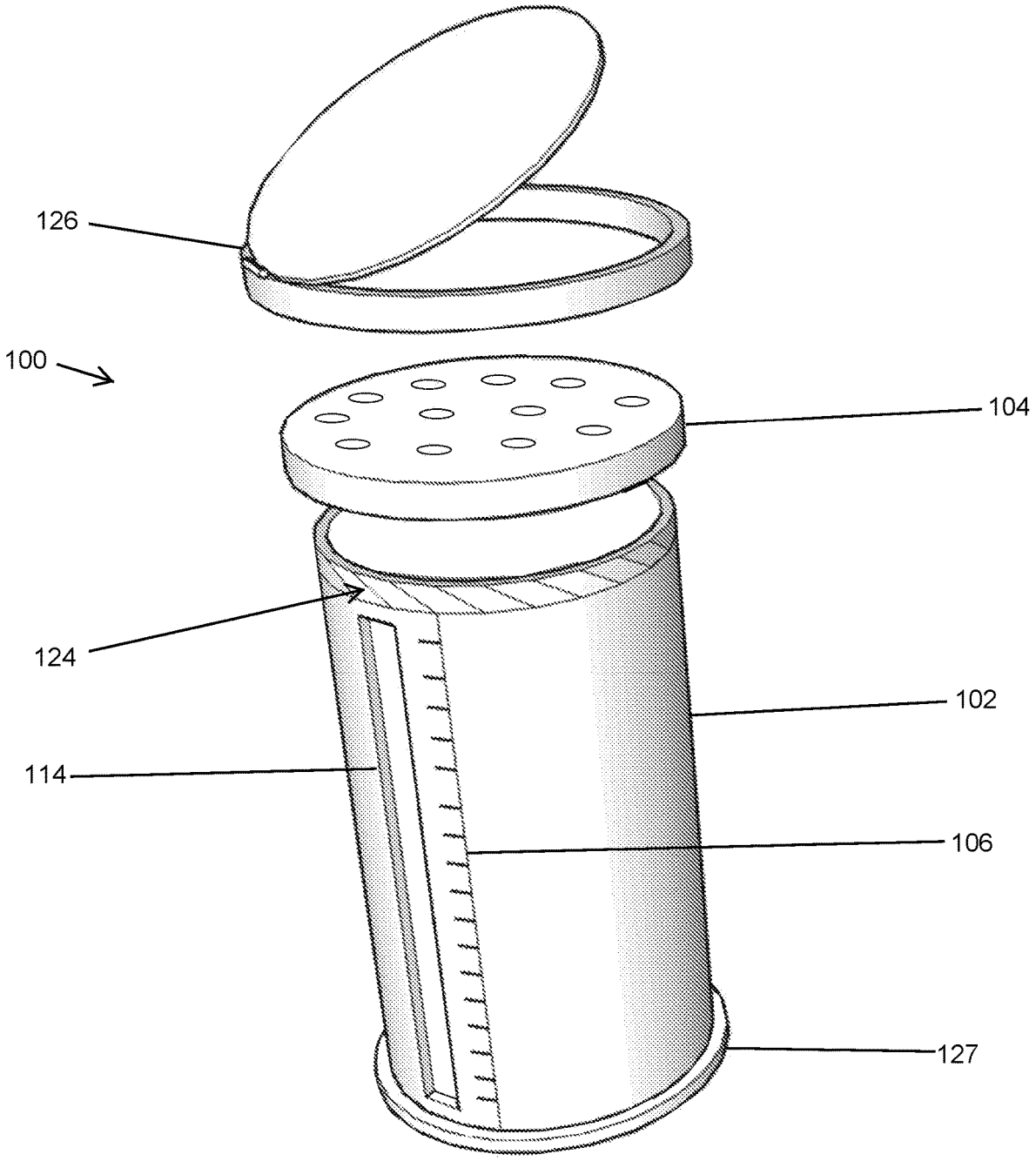
FIG. 7 is a front perspective, exploded view of the shaker device, depicted with a perforated lid and a hinged cap, according to a sixth embodiment of the present disclosure.
Figure 8:
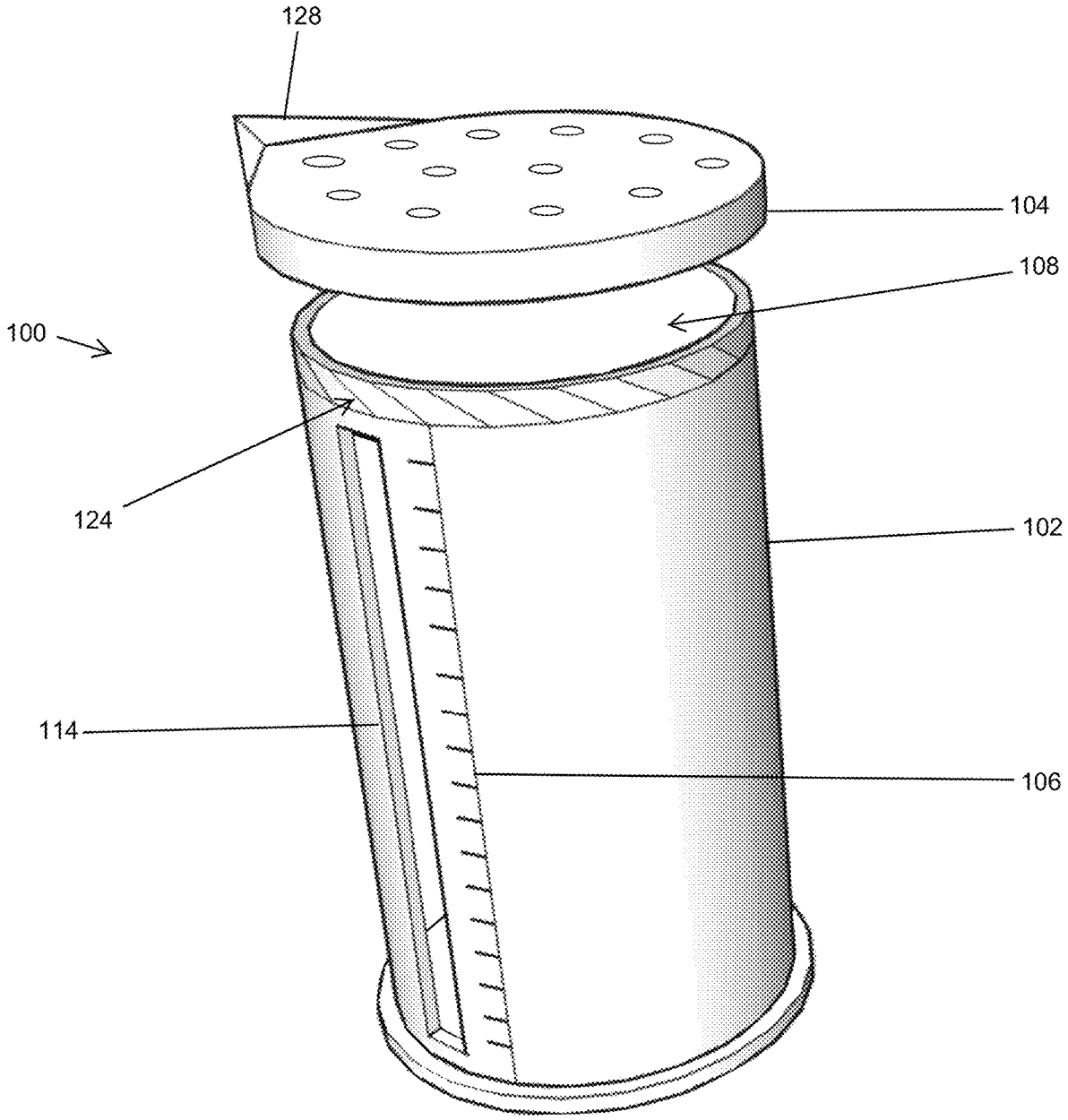
FIG. 8 is a front perspective, exploded view of the shaker device, depicted with a pouring protrusion disposed on the lid, according to a seventh embodiment of the present disclosure.

With reference to FIG. 7, the shaker device 100 includes a perforated lid 104 configured to enhance the control of the amount of the material dispensed from the shaker device 100 in operation. With continued reference to FIG. 7, the shaker device 100 further includes a cap 126. The cap 126 is a hinged cap configured to selectively seal the shaker device 100. The dispensing apparatus 127 is shown with an indexing rotatable handle disposed on a terminal end of the storage body 102. With reference to FIG. 8, the lid 104 is shown with a pouring protrusion 128 configured to control a flow of material dispensed from the shaker device 100 in operation.

Figure 9:
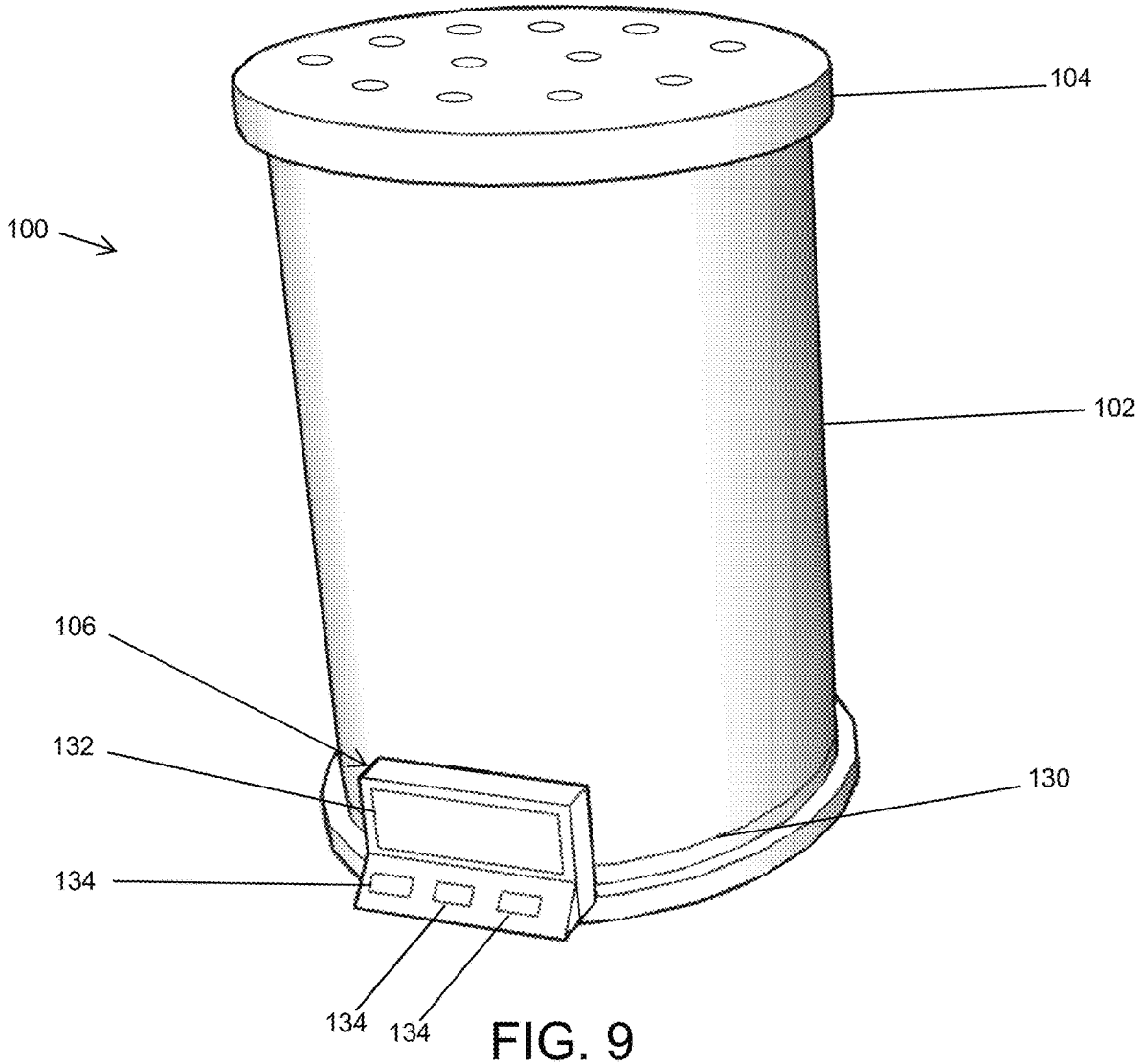
FIG. 9 is a front perspective, exploded view of the shaker device, depicted with a scale, a control panel, and a display, according to an eighth embodiment of the shaker device.

With reference to FIG. 9, the storage body 102 further includes a scale 130 configured to measure the mass of the material within the storage body 102. Where the storage body 102 is provided with the scale 130, the storage body 102 is substantially opaque. The scale 130 includes the display 132 and the control panel 134.

Figure 10:
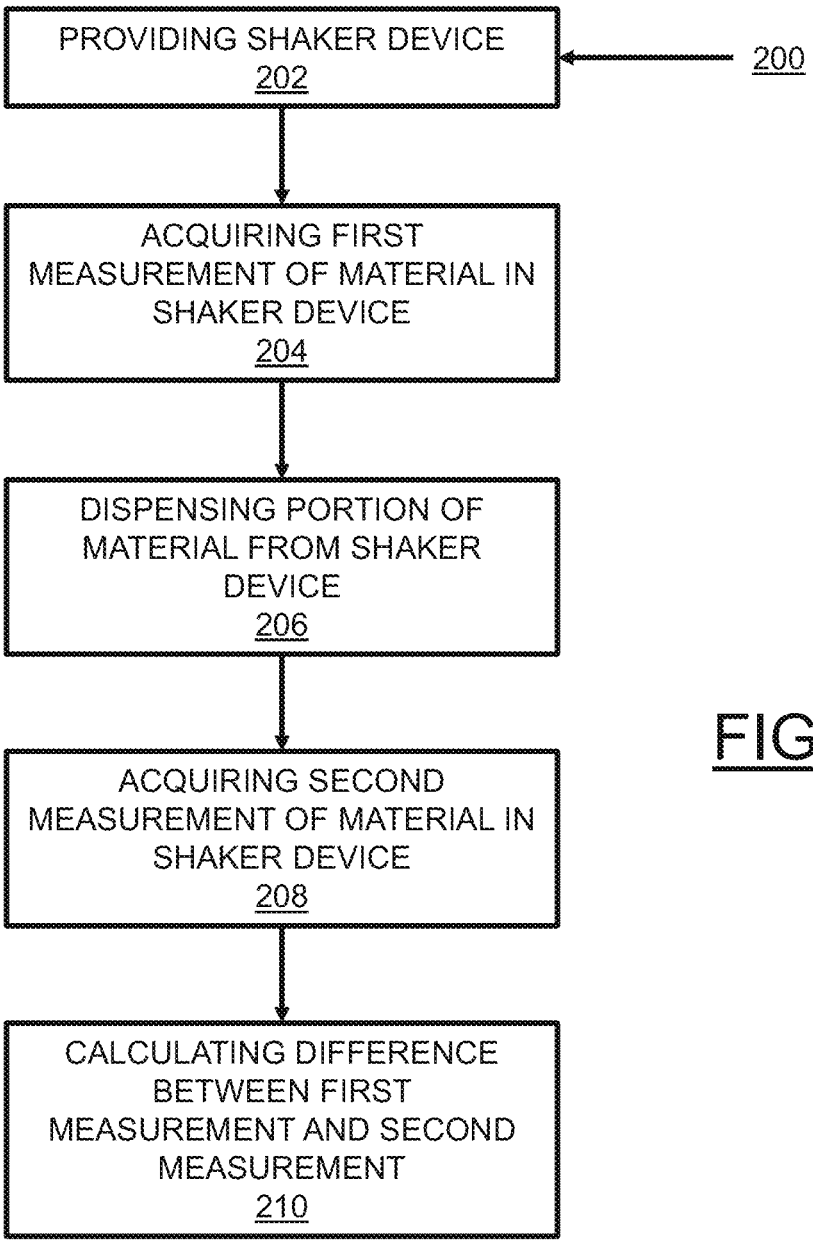
FIG. 10 is a flowchart of a first method for using an embodiment of a shaker device, as shown in FIGS. 1-8, according to the present disclosure.

As shown in FIG. 10, the shaker device 100 can be used in a first method 200 according to the present technology. The first method 200 includes a step 202 of providing a shaker device 100 including the storage body 102, the lid 104, and the measurement system 106. The first method 200 includes another step 204 of acquiring a first measurement of the amount of the material in the shaker device 100. Next, the first method 200 includes a step 206 of dispensing a portion of the material from the shaker device 100. The first method 200 then includes a step 208 of acquiring a second measurement of the amount of the material in the shaker device 200. The first method 200 then includes a step 210 of calculating a difference between the first measurement and the second measurement.

Figure 11:
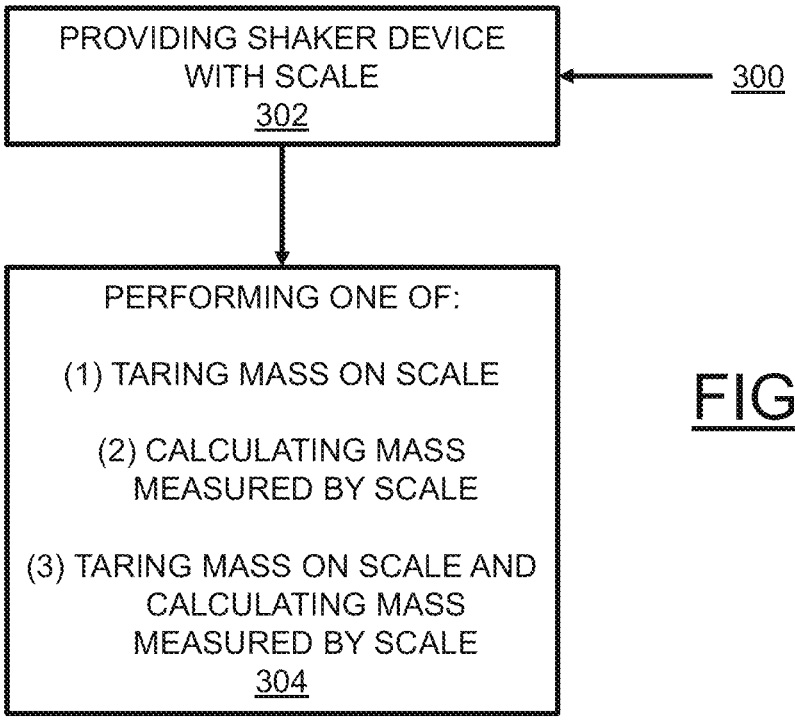
FIG. 11 is a flowchart of a second method for using the shaker device, shown in FIG. 9, according to the present disclosure.

In certain embodiments, as shown in FIG. 11, the shaker device 100 may be used according to a second method 300. The second method 300 includes a step 302 of providing a shaker device 100 including the storage body 102, the lid 104, the scale 130, the display 132, and the control panel 134. The second method 300 includes another step 304 of performing one of taring the calculated mass on the scale 130, calculating the mass measured by the scale 130, and taring the mass on the scale 130 and calculating the mass measured by the scale 130.

Advantageously, the shaker device measures the amount of material a user dispenses while militating against additional steps, transfers, and calculations to the culinary process, while also enhancing the repeatability of recipes. Each embodiment of the shaker device desirably permits the user to measure the amount of material dispensed from the shaker device without requiring additional measuring tools or storage containers.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A shaker device configured to retain and selectively dispense a material, the shaker device comprising:

a storage body configured to hold the material and having an opening;

a lid selectively disposed over the opening;

a measurement system configured to identify an amount of the material within the storage body;

an opaque outer cover having a top edge and a bottom edge, the outer cover configured to receive the storage body therein, the outer cover having an elongated content window with a transparent or translucent portion, the elongated content window having a top end spaced apart from the top edge and a bottom end spaced apart from the bottom edge, the measurement system disposed on the outer cover adjacent to the content window, the measurement system including a range of units of measurement defined by markings; and wherein the outer cover is coupled to the storage body through a friction fit, the friction fit configured to permit for a manual movement by a user of the outer cover along the storage body, and to selectively hold the outer cover in a fixed position along the storage body following the manual movement, and wherein the friction fit is provided by a tab feature disposed on an inner circumference of the outer cover and a plurality of ridges disposed along a length of an outer circumference of the storage body.

2. The shaker device of claim 1, wherein the outer cover is bi-directionally slidably disposed over the storage body.

3. The shaker device of claim 1, wherein the measurement system includes an indication arrow, the indication arrow selectively moveable along the range of units of measurement, the indication arrow configured to mark a first measurement before the material is dispensed.

4. The shaker device of claim 1, wherein the lid of the storage body is a perforated lid.

5. The shaker device of claim 4, further comprising a selectively removable cap disposed over the perforated lid.

6. The shaker device of claim 5, wherein the cap is coupled to the storage body.

7. The shaker device of claim 5, wherein the cap has a hinged door.

8. The shaker device of claim 1, wherein the lid has a pouring protrusion configured to direct a flow of the material from the storage body.

9. The shaker device of claim 1, wherein:

the storage body includes another opening;

and a plunger is disposed within the storage body through the another opening, the plunger configured to conform to an interior cross-section of the storage body.

10. The shaker device of claim 9, wherein the plunger includes a head configured to be disposed adjacent to the material and along the measurement system, the head further configured to indicate a volume of the material within the storage body along the range of units of measurement.

11. The shaker device of claim 1, further comprising a dispensing apparatus configured to selectively release the material in a predetermined amount.

12. A method of using a shaker device configured to retain and selectively dispense a material, the method comprising the steps of:

providing a shaker device including:

a storage body configured to hold the material and having an opening;

a lid selectively disposed over the opening; and a measurement system configured to identify an amount of the material within the storage body;

an opaque outer cover having a top edge and a bottom edge, the outer cover configured to receive the storage body therein, the outer cover having an elongated content window with a transparent or translucent portion, the elongated content window having a top end spaced apart from the top edge and a bottom end spaced apart from the bottom edge, the measurement system disposed on the outer cover adjacent to the content window, the measurement system including a range of units of measurement defined by markings; and wherein the outer cover is coupled to the storage body through a friction fit, the friction fit configured to permit for a manual movement by a user of the outer cover along the storage body, and to selectively hold the outer cover in a fixed position along the storage body following the manual movement, and wherein the friction fit is provided by a tab feature disposed on an inner circumference of the outer cover and a plurality of ridges disposed along a length of an outer circumference of the storage body;

acquiring a first measurement of an amount of the material in the storage body;

dispensing a portion of the material from the shaker device; and acquiring a second measurement of the amount of the material in the storage body.

13. The method of claim 12, wherein the method further includes a step calculating a difference between the first measurement and the second measurement.

* * * * *